US008516701B2

(12) United States Patent
Pautler

(10) Patent No.: US 8,516,701 B2
(45) Date of Patent: Aug. 27, 2013

(54) MANIFOLD BENDING SUPPORT AND METHOD FOR USING SAME

(75) Inventor: Donald Robert Pautler, Lockport, NY (US)

(73) Assignee: Delphi Technologies, Inc., Troy, MI (US)

( * ) Notice: Subject to any disclaimer, the term of this patent is extended or adjusted under 35 U.S.C. 154(b) by 640 days.

(21) Appl. No.: 12/778,565

(22) Filed: May 12, 2010

(65) Prior Publication Data

US 2011/0277954 A1 Nov. 17, 2011

(51) Int. Cl.
*B21D 51/38* (2006.01)
*B23P 15/26* (2006.01)

(52) U.S. Cl.
USPC ..... 29/890.052; 29/890.04

(58) Field of Classification Search
USPC ..... 29/890.052, 890.04; 165/149, 152, 165/153, 174, 175, 176
See application file for complete search history.

(56) References Cited

U.S. PATENT DOCUMENTS 1,417,691 A * 5/1922 Romans ..... 60/325
5,251,857 A * 10/1993 Grice et al. ..... 248/62
5,253,837 A * 10/1993 Loux ..... 248/250
5,390,882 A * 2/1995 Lee et al. ..... 248/68.1
5,460,342 A * 10/1995 Dore et al. ..... 248/74.2
5,553,975 A * 9/1996 Elkins ..... 405/184.4
5,820,048 A * 10/1998 Shereyk et al. ..... 248/68.1
5,931,423 A * 8/1999 Heideloff ..... 248/74.4
6,254,040 B1 * 7/2001 Mc Grath ..... 248/62
6,550,962 B1 * 4/2003 Yang et al. ..... 374/147
6,672,026 B2 * 1/2004 Sumerak ..... 52/690
6,682,025 B2 * 1/2004 Turner et al. ..... 248/65
D531,010 S * 10/2006 Vrame ..... D8/354
7,284,302 B2 * 10/2007 Lares ..... 24/16 PB
7,621,488 B2 * 11/2009 Miller ..... 248/71
7,661,634 B2 * 2/2010 Thompson ..... 248/74.3
7,832,420 B2 * 11/2010 Hoskisson et al. ..... 137/318
2003/0102116 A1 * 6/2003 Memory et al. ..... 165/173
2003/0159813 A1 * 8/2003 Baldantoni ..... 165/140
2008/0060199 A1 * 3/2008 Fuller et al. ..... 29/890.052
2012/0297723 A1 * 11/2012 Siddiqui et al. ..... 52/698

* cited by examiner

*Primary Examiner* — David Angwin
(74) *Attorney, Agent, or Firm* — James M. Chan

(57) ABSTRACT

A method is provided to use a bending support to manufacture a heat exchanger assembly. The method includes the steps of providing a bending support having a bracing member, affixing a refrigerant conduit onto the bracing member, inserting the refrigerant conduit and the bending support into a manifold header, positioning the manifold onto work a surface of a mandrel, such that bracing member of the bending support is substantially perpendicularly to the work surface of the mandrel, and bending the manifold onto the working surface of mandrel forming an inner radius of bent, such that the bracing member supports the inner diameter of the manifold header, thereby preventing the deforming of the inner radius of the bent manifold header.

8 Claims, 6 Drawing Sheets

MANIFOLD BENDING SUPPORT AND METHOD FOR USING SAME

TECHNICAL FIELD OF INVENTION

The subject invention relates generally to a manifold bending support; more particularly to a bending support adapted to be inserted into a manifold header of a heat exchanger to prevent the manifold header from collapsing during the bending of the manifold; and a method for using the bending support for manufacturing a heat exchanger having at least one bent manifold.

BACKGROUND OF THE INVENTION

Due to their high heat transfer efficiency, automotive style brazed heat exchangers have been modified for residential and commercial air conditioning and heat pump applications. A typical modified automotive heat exchanger includes a pair of manifold headers having a plurality of flat tubes in hydraulic connection therebetween for refrigerant flow from one manifold header to the other. Having uniform refrigerant distribution through the plurality of flat tubes is important for optimal heat transfer. To provide for uniform refrigerant distribution through the core of flat tubes, larger diameter manifold headers are used in conjunction with internal refrigerant distribution and collection conduits in the inlet and outlet manifold headers, respectively.

In order to meet packaging constraints for residential and commercial applications, the larger diameter manifold headers of the modified automotive heat exchanger may be bent about an axis on a mandrel. With larger diameter manifold headers, the bending process has a tendency to deform the wall of the manifold header into a substantially egg-shaped cross sectional profile.

It is desirable to have a bending support adapted for use in the bending of a manifold header of a heat exchanger, in which the bending support prevents stress concentrations from deforming the inner radius of the bend. It is further desirable to have a bending support adapted to hold and maintain the internal refrigerant conduit in a predetermined position within the manifold header during the bending process and which assists in the bending of the internal refrigerant conduit to conform to the bend contour of the manifold. It is still further desirable for a method of using the bending support in the manufacturing of a heat exchanger having a bent manifold header that includes an internal refrigerant conduit conforming to the bent contour of the manifold.

SUMMARY OF THE INVENTION AND ADVANTAGES

An embodiment of the present invention provides a bending support adapted to be inserted into a manifold header that has an internal refrigerant conduit of a heat exchanger assembly and a method of using the bending support in the manufacturing of the heat exchanger assembly.

The bending support includes a substantially planar bracing member with a length (L) that is substantially equal to that of the inner diameter (I.D.) of the manifold header that the bending support is ultimately inserted in. Extending from a surface of the bracing member is a pair of bracketing members that are spaced apart at a distance substantially equal that of the outer diameter (O.D.) of the refrigerant conduit. The pair of bracketing member and the portion of the planar bracing member therebetween define a refrigerant conduit clip. The interior surface of the refrigerant conduit clip includes a skived pattern defining a plurality of teeth or protrusions that aids in the engagement of the refrigerant conduit clip onto the internal refrigerant conduit. An aperture located on the planar bracing member provides an unobstructed refrigerant pathway for refrigerant flow to or from the internal refrigerant conduit.

A plurality of the bending supports are oriented and clipped onto the refrigerant conduit at predetermined locations prior to the refrigerant conduit being inserted into the manifold header. A first bending support is clipped onto the center or apex A of the desired bend, a second and third bending supports are clipped onto either end of the bend as it transitions into a straight run. The header manifold is oriented toward a mandrel where the bracing member of the bending support is substantially perpendicular to the work surface of the mandrel. The bending support substantially maintains the inner diameter of the manifold header to prevent the manifold header from being crushed. Also, the bending support serves to maintain the refrigerant conduit in its desired position during the bending process.

Accordingly, the bending support maintains the diameter of the manifold header during the bending process to prevent the inner radius wall from collapsing or deforming. The bending support also holds and maintains the internal refrigerant conduit in a predetermined position during the bending process to conform to the bend contour of the manifold header, thereby preventing the refrigerant conduit from deforming.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE EXEMPLARY EMBODIMENT

Figure 1:
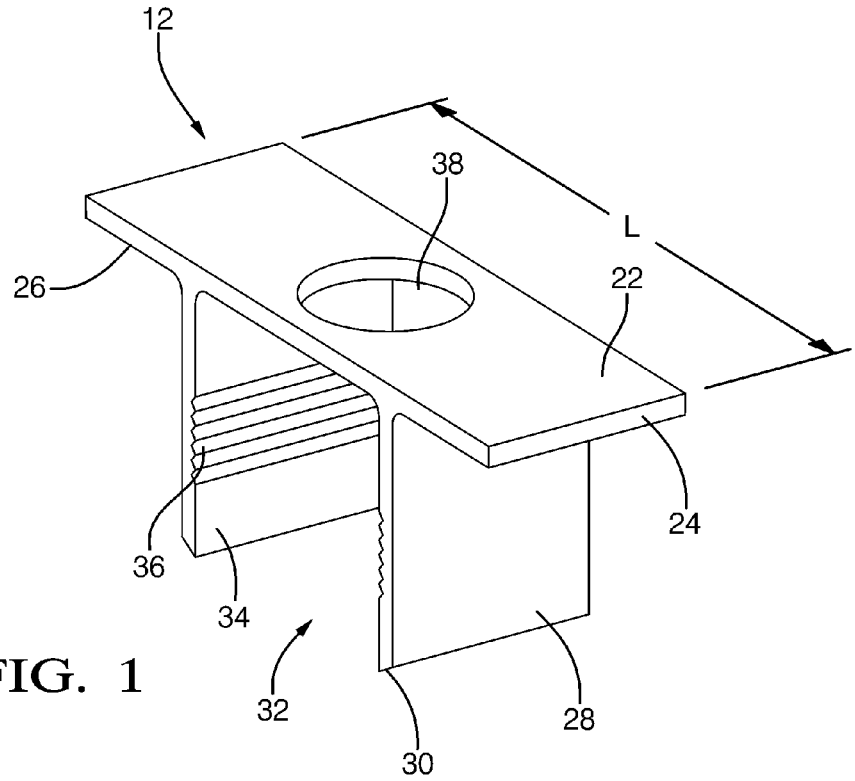
FIG. 1 shows a perspective view of one embodiment of the bending support.

This invention will be further described with reference to the accompanying drawings, wherein like numerals indicate corresponding parts throughout the views. The modified automotive heat exchanger represented in the drawings generally includes a first manifold header 14 having a substantially round cross-sectional area, a second manifold (not shown) spaced apart from the first manifold header 14, an internal refrigerant distribution or collection conduit 20 extending within one or both of the manifold headers, and a plurality of flat tubes 44 interconnecting the first 14 and second manifold headers for refrigerant flow from one manifold header to the other. The modified automotive heat exchanger shown is for illustrative purposes and represents one of many exemplary embodiment of the invention; therefore, the modified automotive heat exchanger shown should not be considered as a limiting example. In the following description of the bending support 12 and the method of using the bending support 12, the modified automotive heat exchanger will be generically referred to as a heat exchanger assembly 10.

Shown in FIGS. 1-6B is a bending support 12 adapted to be inserted into a manifold header 14 of a heat exchanger assembly 10. The bending support 12 has features that enable it to support the inner radius wall 16, best shown in FIG. 5B, of the manifold header 14 during the bending process to prevent the inner radius wall 16 from forming an egg-shaped cross sectional profile. The bending support 12 also has features that hold and maintain the internal refrigerant conduit 20 in a predetermined position during the bending process to conform to the bend contour of the manifold header 14, thereby preventing the refrigerant conduit 20 from deforming. The details and advantages of these features will be clearer with the description that follows.

Figure 2:
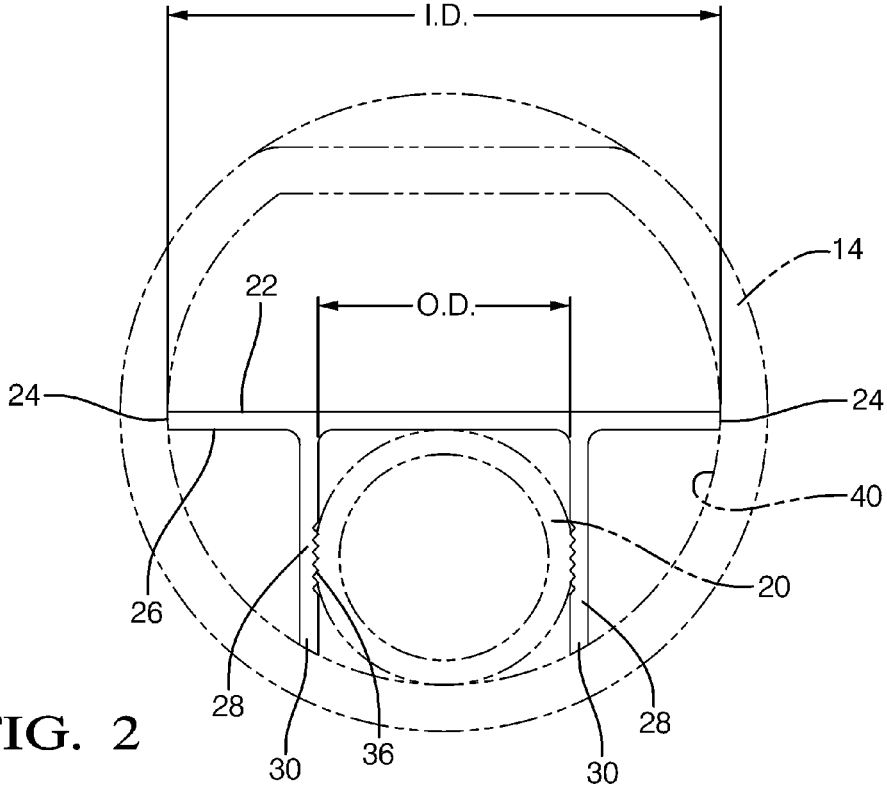
FIG. 2 shows a cross-sectional end view of a manifold header having a bending support maintaining a refrigerant conduit in a predetermined position.

FIGS. 1 and 2 show a bending support 12 having a substantially planar bracing member 22. The bracing member 22 has a length (L) that is substantially equal to that of the inner diameter (I.D.) of the manifold header 14 that the bending support 12 is ultimately inserted in. The bracing member 22 includes two opposing bracing member edges 24 and a bracing member surface 26.

Extending substantially perpendicularly from the bracing member surface 26 is a pair of bracketing members 28. Each of the two bracketing members 28 includes a bracketing member interior surface 34 and a bracketing member distal end 30. The pair of bracketing members 28 together with a portion of the bracing member 22 therebetween define a refrigerant conduit clip 32. The pair of bracketing members 28 is spaced at a distance substantially equal that of the outer diameter (O.D.) of the refrigerant conduit 20 that the bending support 12 ultimately engages and includes an interior bracketing member surface 34 having a skived pattern 36 defining a plurality of teeth or protrusions 36. The portion of the bracing member 22 between the pair of bracketing members 28 defines an aperture 38.

FIG. 2 shows the bending support 12 inserted into the interior of the header manifold 14. The bending support 12 is sized such that the opposing bracing member edges 24 and the bracketing member distal ends 30 abut the interior surface 40 of manifold header 14. It is preferable that the bracing member 22 extends across the inner diameter of the manifold header 14. To ensure a secure fit, the length (L) of the bracing member 22 may be sized slightly longer than the inner diameter (I.D.) of the manifold header 14 to form an interference fit. To maximize the contact area to ensure a tight fit, the bracketing member distal ends 30 and bracing member edges 24 may be contoured to conform to the curvature of the interior surface 20 of the manifold header 14. The bending support 12 may be fabricated as a continuous aluminum extrusion and then cut to the desired length.

Figure 3:
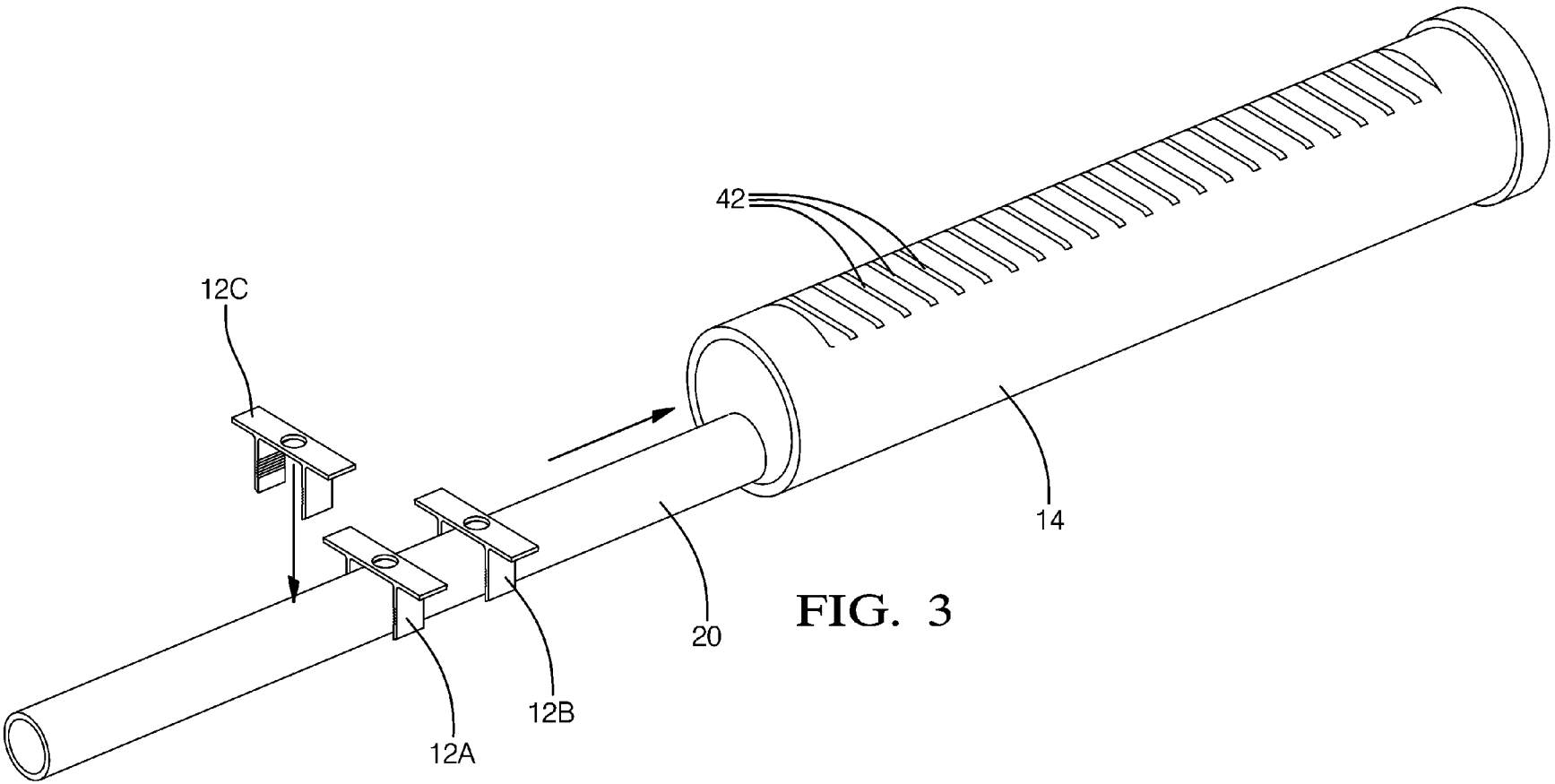
FIG. 3 shows a perspective view of a plurality bending supports being assembled onto the refrigerant conduit prior to the insertion of the refrigerant conduit assembly into the manifold header.

FIG. 3 shows a plurality of bending supports 12 being clipped onto the refrigerant conduit 20 prior to the insertion of the refrigerant conduit 20 into the interior of the manifold header 14. Each bending support 12 is pre-oriented and clipped onto a strategic predetermined location along the refrigerant conduit 20 as described in the following.

Figure 5A:
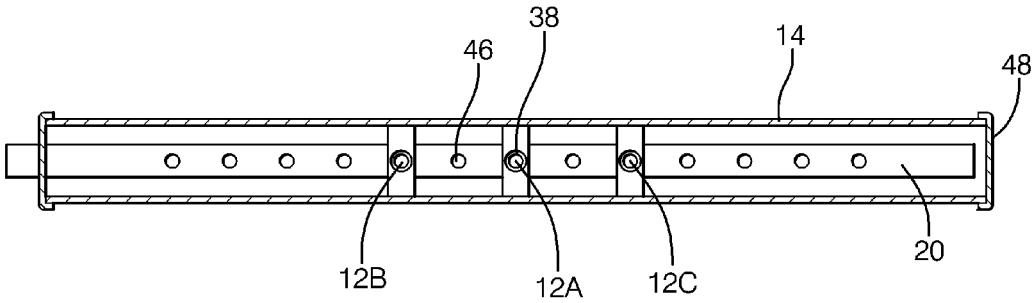
FIG. 5A shows a cross-sectional view of the manifold header having multiple bending supports engaged to the refrigerant conduit.
Figure 5B:
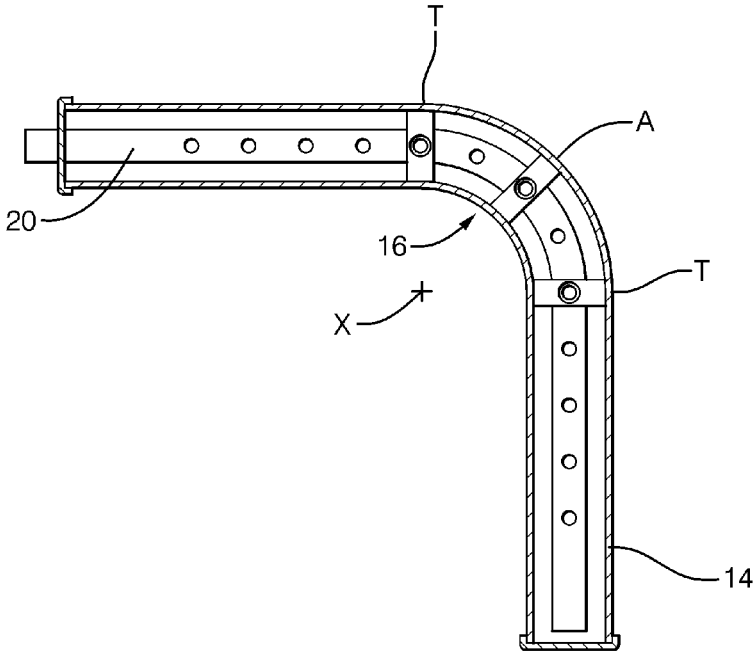
FIG. 5B shows a cross-sectional view of the manifold header of FIG. 5A bent at a 90 degree angle about an X-axis.

Prior to the insertion of the refrigerant conduit 20 into the manifold header 14, the bend apex of the refrigerant conduit 20 corresponding to the desired bend apex (A) of the manifold header 14 is identified. A first bending support 12A, a second bending support 12B, and a third bending support 12C are provided. With reference to FIGS. 3, 5A, and 5B, the first bending support 12A is clipped onto the refrigerant conduit 20 at or about the portion of the refrigerant conduit 20 corresponding to the desired bend apex (A) of the manifold header 14. The first bending support 12A is oriented in a direction in which one of the bracing member edges 24 is directed toward the X-axis, the axis about which the manifold header 14 is bent and the length (L) of the bracing member 22 extends radially from the X-axis. The second and third bending supports 12B, 12C are clipped onto the refrigerant conduit 20 at or about the portions that correspond to the bend transitions (T) of the manifold header 14. The second and third bending supports 12B, 12C are oriented in the same direction as that of the first bending support 12A, in which one of the bracing member edges 24 is directed toward the X-axis.

Figure 4:
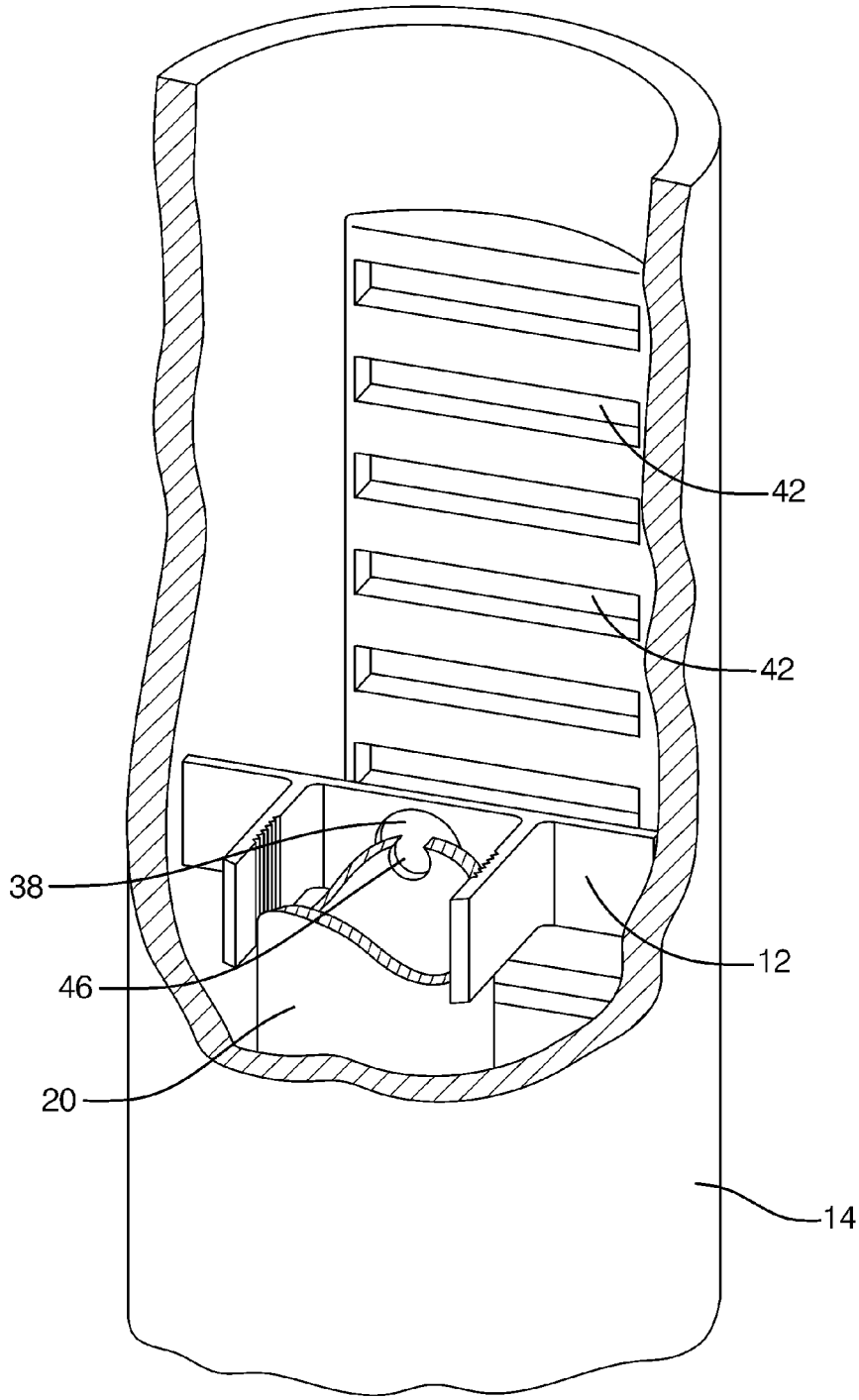
FIG. 4 shows a partial cut-away perspective view of a manifold header having a bending support engaged to the refrigerant conduit.

Shown in FIG. 4 is a partial cut-away perspective view of the manifold header 14 having a bending support 12 clipped onto the refrigerant conduit 20. The manifold header 14 shown includes a plurality of slots 42 for the insertion of flat tubes 44. In this exemplary embodiment, the aperture 38 of the bending support is aligned with the refrigerant distribution or collection ports 46 of the refrigerant conduit 20 for unrestricted refrigerant flow to or from the refrigerant conduit 20. However, it is not necessary for the aperture 38 to be directly aligned with the ports 46 of the refrigerant conduit 20.

Shown in FIG. 5A, three bending supports 12A, 12B, 12C are clipped onto the refrigerant conduit 20 and the assembly is inserted into the manifold header 14. At this stage of the assembly, manifold caps 48 may be placed on either end of the manifold header 14, one end of the flat tubes 44 inserted into the corresponding tube slots 42, and the other end of the flat tubes 44 may be inserted into the corresponding tube slots of the other manifold header (not shown) forming the heat exchanger assembly 10. The assembly may be brazed into a solid integral heat exchanger assembly 10. After brazing, the manifold headers 14 may be bent on a mandrel to conform the heat exchanger assembly 10 to the desired packaging requirement. Alternatively, the headers manifold 14 with the inserted refrigerant conduits 20 and bending supports 12 may be individually bent prior to the assembly and brazing of the remaining components of the heat exchanger assembly.

Shown in FIG. 5B, is cross sectional view of a bent manifold header 14 forming a right angle along with the relative location of the three bending supports 12A, 12B, and 12C. The first bending support 12A is located at the center or apex A of the bend; the second and third bending support 12B, 12C are located at either end of the bend as it transitions into a straight run.

Figure 6A:
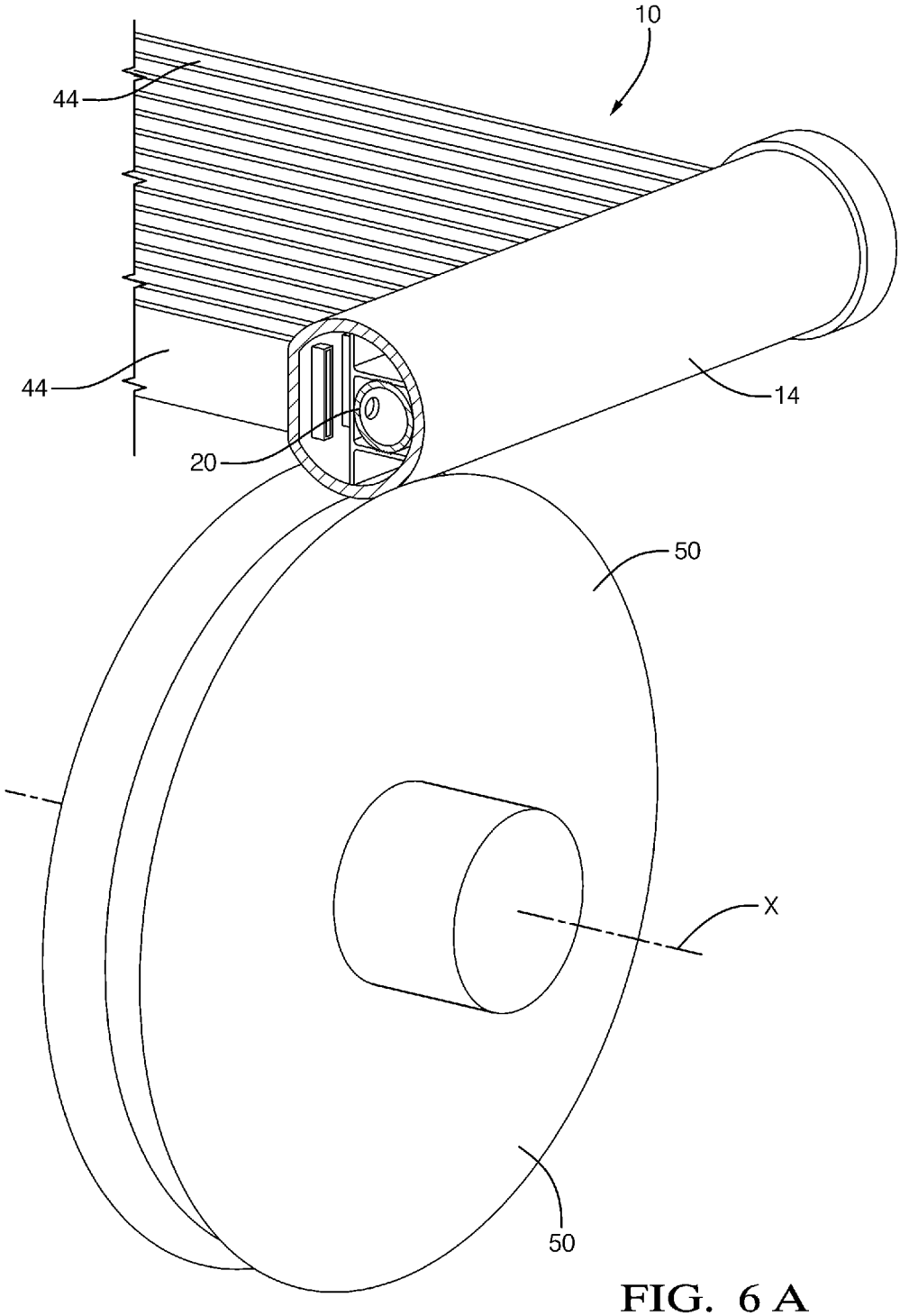
FIG. 6A shows a cut-away perspective view of the manifold header having the bending support properly positioned on a mandrel.
Figure 6B:
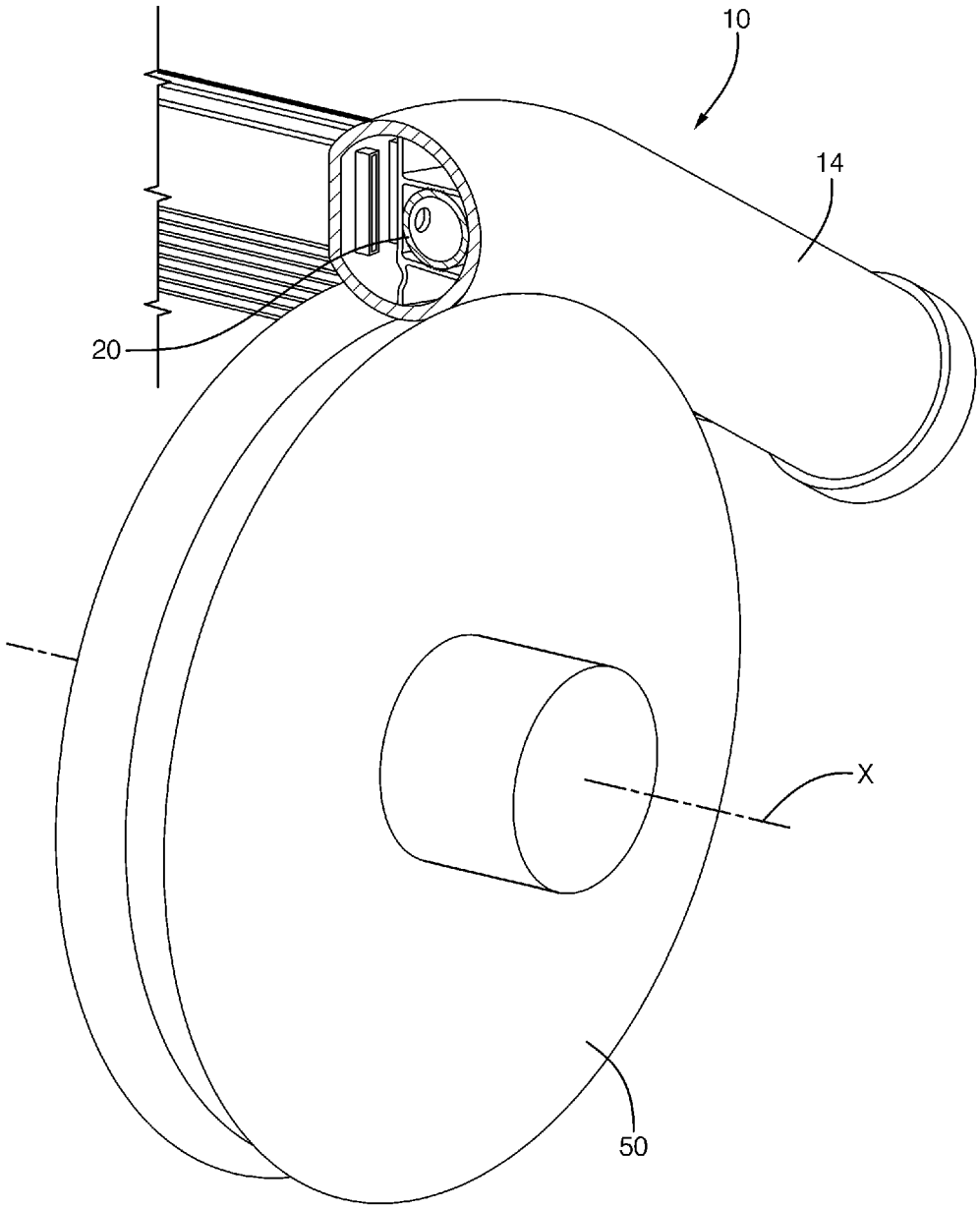
FIG. 6B shows the cut-away perspective view of the manifold header of FIG. 6A being bent about the X-axis on the mandrel.

Shown in FIG. 6A is a heat exchanger assembly 10 having the header manifold 14 positioned onto a mandrel 50. The header manifold 14 is oriented where the bracing member 22 of the bending support 12 is substantially perpendicular to the work surface of the mandrel. As a force is applied causing the header manifold 14 to bend onto the work surface and about the X-axis, a portion of the force is transmitted to the refrigerant conduit 20 via the bending support 12 assisting in the bending of the refrigerant conduit 20 to a curvature that closely conforms to the bend curvature of the manifold header 14; thereby preventing any pinch points from forming in the refrigerant conduit 20. The bending support 12 also aids in maintaining the desired position of the refrigerant conduit 20 relative to the manifold header 14 during the bending process.

The bending support 12 supports the inner radius of the manifold header 14 during the bending process, thereby providing the advantage of preventing stress concentrations from deforming the inner radius of the bend. The bending support 12 maintains the internal refrigerant conduit 20 in a predetermined position during the bending process to conform the bend of the refrigerant conduit 20 to the bend of the manifold header 14, thereby providing the advantage of preventing crimps in the refrigerant conduit 20.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

Having described the invention herein, we claim:

1. A method of manufacturing a heat exchanger, comprising the steps of:

providing a manifold header having an interior surface defining an inner diameter;

providing a bending support having two opposing edges;

providing a refrigerant conduit;

affixing said refrigerant conduit onto said bending support between said two opposing edges;

inserting refrigerant conduit and said bending support into said manifold header, thereby abutting said two opposing edges of said bending support against said interior surface across said inner diameter of said manifold header, providing a mandrel having a work surface;

positioning said manifold onto said work surface, wherein one of said opposing edges of said bending support is oriented toward said work surface;

bending said manifold onto said work surface of said mandrel forming an inner radius of the bend, wherein said bending support substantially maintains said inner diameter and prevents said manifold header from deforming at said inner radius of the bend during bending process.

2. The method of manufacturing a heat exchanger of claim 1, further comprise the steps of:

providing a refrigerant conduit clip integral with said bending support; and engaging said refrigerant conduit onto said conduit clip prior to said step of abutting said two opposing edges of the bending support against said interior surface across said inner diameter of manifold header, wherein said conduit clip maintains position of the refrigerant conduit within said manifold during bending process.

3. The method of manufacturing a heat exchanger of claim 2, further comprise the steps of:

providing a skived portion on said conduit clip defining a plurality of saw tooth surfaces; and engaging said refrigerant conduit onto said skived surface.

4. The method of manufacturing a heat exchanger of claim 3, further comprise the steps of:

providing an aperture on said bending support.

5. A method of manufacturing a heat exchanger, comprising the steps of:

providing a manifold header having an interior surface defining an inner diameter;

providing a bending support having a substantially planar bracing member, wherein said bracing member includes a length substantially the same as said inner diameter of said manifold header;

providing a mandrel having a work surface;

providing a refrigerant conduit;

affixing said refrigerant conduit onto a portion of said planar bracing member of said bending support;

inserting said refrigerant conduit and said bending support into said manifold header, wherein said bracing member of bending support abuts said inner surface of said manifold;

positioning said manifold onto said work surface of said mandrel, wherein said bracing member of said bending support is substantially perpendicularly to said work surface of said mandrel; and bending said manifold onto said working surface of said mandrel forming an inner radius of bent, wherein said bracing member supports inner diameter of said manifold header, thereby preventing the deforming of the inner radius of the bent manifold header.

6. A method of manufacturing a heat exchanger, comprising the steps of:

providing a manifold header having an interior surface defining an inner diameter;

providing a refrigerant conduit having an outer diameter;

providing a plurality of bending supports, wherein each said bending support includes:

a bracing member having a planar surface and two opposing edges substantially perpendicular to said planar surface;

a pair of bracketing members extending substantially perpendicular from said planar surface, wherein said bracketing members each includes a distal end and are spaced apart at a distance substantially equal to said outer diameter of said refrigerant conduit, wherein each of said bending supports are sized to be inserted into said manifold heading, wherein said opposing edges of said bracing member and said distal ends of said bracketing members abut the inner surface of said manifold header;

securing a first bending support member onto a first predetermined location on said refrigerant conduit;

inserting said refrigerant conduit into said manifold header wherein said opposing edges of said planar member and said distal ends of said bracketing members abut said interior surface of said manifold header;

aligning and engaging said manifold header onto a work surface of a mandrel, in which said edge of said bracing member is oriented toward said work surface and said bracing member extends substantially perpendicular to said work surface;

and applying a force onto said manifold header thereby bending said manifold header, wherein said bracing member absorbs and distributes a portion of the force, thereby preventing the deforming of the inner radius of the bent manifold header.

7. The method of manufacturing a heat exchanger of claim 6, further comprise the steps of:

securing a second bending support onto a second predetermined location on said refrigerant conduit; and securing a third bending support member onto a third predetermined location on said refrigerant conduit prior to inserting said refrigerant conduit into said manifold header.

8. The method of manufacturing a heat exchanger of claim 7, wherein said first predetermined location is desired apex of bend, and second and third predetermined locations is the desired transition of the bend on either side of said apex of the bend.

* * * * *